US007696139B2

(12) United States Patent
Okamura et al.

(10) Patent No.: US 7,696,139 B2
(45) Date of Patent: Apr. 13, 2010

(54) GREASE COMPOSITION FOR PIVOT ASSEMBLY BEARING AND BEARING FOR PIVOT ASSEMBLY

(75) Inventors: Seiji Okamura, Osaka (JP); Motoharu Akiyama, Nagano (JP); Hiroki Iwamatsu, Hyogo (JP); Yasuhiro Miyamoto, Hyogo (JP)

(73) Assignees: Minebea Co., Ltd., Nagano (JP); Nippon Grease Co., Ltd., Kobe-shi (JP)

( * ) Notice: Subject to any disclaimer, the term of this patent is extended or adjusted under 35 U.S.C. 154(b) by 582 days.

(21) Appl. No.: 11/525,988

(22) Filed: Sep. 25, 2006

(65) Prior Publication Data

US 2007/0072777 A1 Mar. 29, 2007

(30) Foreign Application Priority Data

Sep. 26, 2005 (JP) ..... P2005-277822
Sep. 21, 2006 (JP) ..... P2006-255510

(51) Int. Cl.
*C10M 115/08* (2006.01)
*C10L 1/22* (2006.01)
*G11B 5/55* (2006.01)

(52) U.S. Cl. ..... 508/552; 508/367; 360/265.6

(58) Field of Classification Search ..... 508/552, 508/367; 360/265.6
See application file for complete search history.

(56) References Cited

U.S. PATENT DOCUMENTS 5,364,544 A * 11/1994 Otake et al. ..... 508/148
5,728,659 A * 3/1998 Naka et al. ..... 508/552
6,352,961 B1 * 3/2002 Iso et al. ..... 508/155
2003/0040442 A1 * 2/2003 Yokouchi et al. ..... 508/155
2003/0158052 A1 * 8/2003 Akiyama ..... 508/363
2004/0224859 A1 * 11/2004 Numazawa et al. ..... 508/364

FOREIGN PATENT DOCUMENTS

JP 3324628 9/2002
JP 2004-323586 11/2004

* cited by examiner

*Primary Examiner*—Glenn A Caldarola
*Assistant Examiner*—Vishal Vasisth
(74) *Attorney, Agent, or Firm*—Foley & Lardner LLP

(57) ABSTRACT

A grease composition for a pivot assembly bearing is provided and includes a thickener of 5 to 25% by mass and a base oil of 95 to 75% by mass with respect to the total mass of the thickener and the base oil. Two or more ureas selected from: urea A: a urea comprising diurea compounds having an aliphatic (ALA)/alicyclic (ACA) substituent; urea B: a urea comprising diurea compounds having an alicyclic (ACA)/aromatic (ARA) substituent; and urea C: a urea comprising diurea compounds having an aromatic (ARA)/aliphatic (ALA) substituent are used as the thickener. A poly α-olefin mixture having a kinematic viscosity at 40° C. of 40 to 70 $mm^2/s$ prepared by mixing poly α-olefin (PAO HV) having a kinematic viscosity at 40° C. of 350 to 450 $mm^2/s$ with poly α-olefin (PAO LV) having a kinematic viscosity at 40° C. of 25 to 40 $mm^2/s$ in a mass ratio of 15:85 to 30:70 is used as a base oil. A lead free additive may be used as an additive.

7 Claims, 4 Drawing Sheets

AVERAGE TORQUE DATA

Unit: g·cm

| | Pb CONTENT | TEST TEMP | | |
|---|---|---|---|---|
| | | -20°C | ROOM TEMP | 80°C |
| EXAMPLE 1 | Pb FREE | 0.756 | 0.362 | 0.302 |
| EXAMPLE 2 | Pb FREE | 0.770 | 0.386 | 0.351 |
| COMPARATIVE EXAMPLE 1 | Pb FREE | 0.883 | 0.488 | 0.445 |
| COMPARATIVE EXAMPLE 2 | Pb INCLUDE | 0.736 | 0.320 | 0.438 |

AVERAGE TORQUE DATA

Unit: g·cm

| | Pb CONTENT | TEST TEMP | | |
|---|---|---|---|---|
| | | -20°C | ROOM TEMP | 80°C |
| EXAMPLE 1 | Pb FREE | 0.756 | 0.362 | 0.302 |
| EXAMPLE 2 | Pb FREE | 0.770 | 0.386 | 0.351 |
| COMPARATIVE EXAMPLE 1 | Pb FREE | 0.883 | 0.488 | 0.445 |
| COMPARATIVE EXAMPLE 2 | Pb INCLUDE | 0.736 | 0.320 | 0.438 |

AVERAGE TORQUE DATA

PEAK-PEAK TORQUE DATA

Unit: g · cm

| | Pb CONTENT | TEST TEMP | | |
|---|---|---|---|---|
| | | -20°C | ROOM TEMP | 80°C |
| EXAMPLE 1 | Pb FREE | 0.230 | 0.087 | 0.120 |
| EXAMPLE 2 | Pb FREE | 0.200 | 0.079 | 0.139 |
| COMPARATIVE EXAMPLE 1 | Pb FREE | 0.258 | 0.173 | 0.172 |
| COMPARATIVE EXAMPLE 2 | Pb INCLUDE | 0.240 | 0.121 | 0.178 |

PEAK-PEAK TORQUE DATA

OUT GAS DATA

CONDITION: 85°C x 3h

UNIT: ng/mg

| | |
|---|---|
| EXAMPLE 1 | 499 |
| EXAMPLE 2 | 530 |
| COMPARATIVE EXAMPLE 1 | 842 |
| COMPARATIVE EXAMPLE 2 | 1257 |

FRICTION COEFFICIENT DATA

CONDITION: 50°C x 100N x 50Hz x 1mm

UNIT: —

| | |
|---|---|
| EXAMPLE 1 | 0.115 |
| EXAMPLE 2 | 0.121 |
| COMPARATIVE EXAMPLE 1 | 0.126 |
| COMPARATIVE EXAMPLE 2 | 0.120 |

FIG. 7

GENERAL PROPERTIES

| ITEM | CONDITION | UNIT | EXAMPLE 1 | EXAMPLE 2 | COMPARATIVE EXAMPLE 1 | COMPARATIVE EXAMPLE 2 |
|---|---|---|---|---|---|---|
| PENETRATION (60W) | 60W @25℃ | — | 216 | 241 | 252 | 256 |
| DROPPING POINT | — | ℃ | >250 | >250 | 271 | 269 |
| OIL SEPARATION | 100℃ x 24h | Wt% | 0.20 | 0.50 | 0.60 | 0.40 |
| EVAPORATION LOSS | 99℃ x 22h | Wt% | 0.15 | 0.12 | 0.07 | 0.13 |

GREASE COMPOSITION FOR PIVOT ASSEMBLY BEARING AND BEARING FOR PIVOT ASSEMBLY

BACKGROUND OF THE INVENTION

1. Field of the Invention

The present invention relates to a grease composition for use in a pivot assembly bearing, more particularly, relates to a grease composition for a pivot assembly bearing which serves in providing a low torque at the beginning of the driving and is excellent in outgas properties and scattering properties, and further, relates to a grease composition for a pivot assembly bearing not including a lead compound, and a bearing for pivot assembly sealed therewith.

2. Description of Background Art

A grease composition has been known which comprises a base oil and a thickener including a diurea compound, and which contains a zinc compound in an amount of 0.1 to 10% by mass based on the total amount of the grease, wherein a diurea compound having an aromatic ring-containing hydrocarbon group having 7 to 12 carbon atoms and a hydrocarbon group having 8 to 20 carbon atoms is used, which is included in an amount of 10 to 30% by mass based on the total amount of the grease such that a value of (number of moles of the aromatic ring-containing hydrocarbon group/(number of moles of the aromatic ring-containing hydrocarbon group+number of moles of the hydrocarbon group)) becomes 0.50 to 1.0 (JP-A No. 2004-323586).

However, it is disclosed that this grease composition is suited for rolling bearings to be incorporated in electrical components of automobiles, engine components used under high-temperature, high-speed and high-load conditions such as alternators and middle pulleys, and electromagnetic clutches for car air-conditioners, or components brought into contact with water such as water pumps, and that hydrocarbon-based oil, mineral oil, ester-based oil, ether-based oil or the like may be used as a base oil.

Furthermore, in grease compositions for sealing the bearings used in computers, apparatuses for manufacturing semiconductors and the like, a low-noise and low-torque grease as typified by greases including a lithium soap as a thickener and an ester oil as a base oil has been used in case where importance is placed on low noise properties and low vibration properties. However, this lithium soap-ester oil-based grease is apt to be scattered, therefore, there is a highly possibility for staining of recording media when it is used without modification (Japanese Patent No. 3,324,628).

Moreover, known greases for use in pivot assembly bearings include a grease developed by the present applicant comprising a mixed base oil including a mineral oil and poly α-olefin, and a diurea compound having an alicyclic hydrocarbon group having 6 to 12 carbon atoms and an aliphatic hydrocarbon group having 8 to 22 carbon atoms as a thickener.

However, this grease composition is disadvantageous in terms of torque properties in a low temperature range and is difficult to suit for environment because of addition of an organic lead compound.

SUMMARY OF THE INVENTION

An object of an illustrative, non-limiting embodiment of the invention is to provide a grease composition for a pivot assembly bearing, which maintains favorable torque properties and flow performances in a low temperature range, and which serves in providing low torque and is excellent in outgas properties and grease scattering properties at a temperature range from room temperature to the driving temperature (about 80° C.) without need of addition of an organic lead compound. Also, the invention is not required to provide the advantages described above, and an illustrative, non-limiting embodiment of the invention may provide different advantages.

According to one aspect of the invention, there is provided a grease composition for a pivot assembly bearing, which comprises: a thickener of 5 to 25% by mass; and a base oil of 95 to 75% by mass with respect to the total mass of the thickener and the base oil. The thickener is a urea mixture comprising two or more ureas selected from the group consisting of: a urea A comprising diurea compounds having at least one of an aliphatic (ALA) substituent and an alicyclic (ACA) substituent (hereinafter referred to as "a urea A"); a urea B comprising diurea compounds having at least one of an alicyclic substituent (ACA) and an aromatic (ARA) substituent (hereinafter referred to as "a urea B"); and a urea C comprising diurea compounds having at least one of an aromatic (ARA) substituent and an aliphatic (ALA) substituent (hereinafter referred to as "a urea C"). The base oil is a poly α-olefin mixture having a kinematic viscosity at 40° C. of 40 to 70 $mm^2/s$, wherein the poly α-olefin mixture is prepared by mixing poly α-olefin having a kinematic viscosity at 40° C. of 350 to 450 $mm^2/s$ (PAO HV) with poly α-olefin having a kinematic viscosity at 40° C. of 25 to 40 $mm^2/s$ (PAO LV) in a mass ratio (PAO HV:PAO LV) of 15:85 to 30:70.

A lead free additive may be used as an additive.

Furthermore, in one aspect of the invention, the urea A (comprising the diurea compounds having an aliphatic (ALA)/alicyclic (ACA) substituent) may comprise the diurea compounds represented by the formulae (1) to (3):

(1)

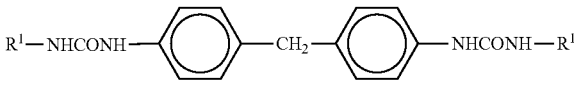

(2)

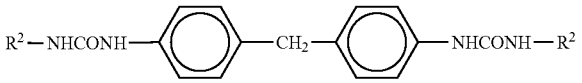

(3)

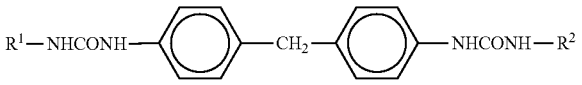

wherein $R^1$ represents an aliphatic hydrocarbon group having 8 to 22 carbon atoms, and $R^2$ represents an alicyclic hydrocarbon group having 6 to 12 carbon atoms, the urea B (comprising the diurea compounds having an alicyclic (ACA)/aromatic (ARA) substituent) may comprise the diurea compounds represented by the formulae (2), (4) and (5):

(2)

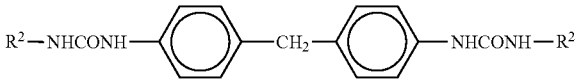

-continued (4)

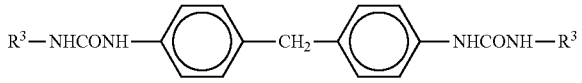

(5)

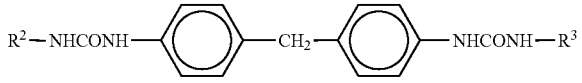

wherein $R^2$ represents an alicyclic hydrocarbon group having 6 to 12 carbon atoms, and $R^3$ represents an aromatic hydrocarbon group having 6 to 20 carbon atoms;

the urea C (comprising the diurea compounds having an aromatic (ARA)/aliphatic (ALA) substituent) may comprise the diurea compounds represented by the formulae (1), (4) and (6):

(1)

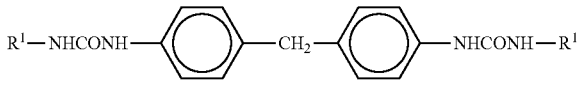

(4)

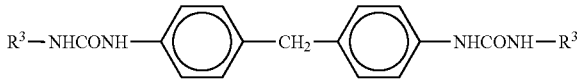

(6)

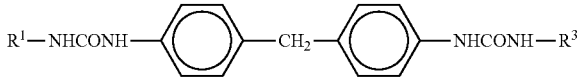

wherein $R^1$ represents an aliphatic hydrocarbon group having 8 to 22 carbon atoms, and $R^3$ represents an aromatic hydrocarbon group having 6 to 20 carbon atoms.

Moreover, in one aspect of the invention, the urea A and the urea B can be used as the urea mixture.

Further, in one aspect of the invention, the urea B and the urea C can be used as the urea mixture.

Additionally, in one aspect of the invention, the urea A and the urea C can be used as the urea mixture.

Still further, in one aspect of the invention, the urea A, the urea B and the urea C can be used as the urea mixture.

In addition, another aspect of the invention provides a bearing for pivot assembly in which such grease is used.

BRIEF DESCRIPTION OF THE DRAWINGS

The features of the invention will appear more fully upon consideration of the exemplary embodiment of the invention, which are schematically set forth in the drawings, in which:

FIG. 7 shows data of general properties.

DETAILED DESCRIPTION OF THE EXEMPLARY EMBODIMENTS

Figures 1, 2:
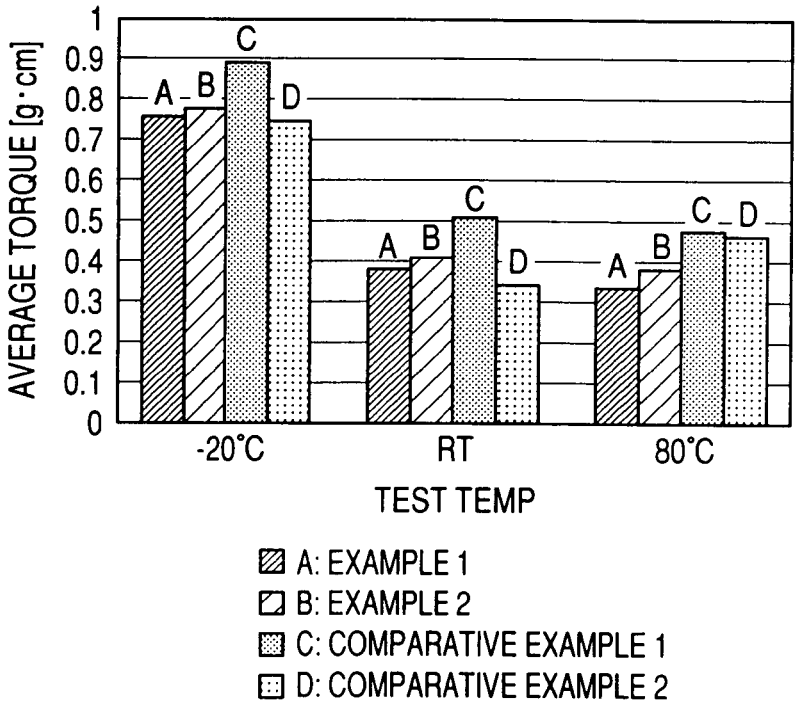
FIG. 1 shows data of average torque.
FIG. 2 shows a graph illustrating data of average torque.

Although the invention will be described below with reference to the exemplary embodiments thereof, the following exemplary embodiments and modifications do not restrict the invention.

According to an exemplary embodiment, use of a readily available base oil and thickener can achieve excellent torque properties in a low temperature range, and can provide a grease composition for a pivot assembly bearing that serves in providing low torque and is excellent in outgas properties and grease scattering properties at a temperature of from room temperature to the driving temperature (about 80° C.) to give a grease which is not harmful to the environment.

A grease composition of an exemplary embodiment of the invention comprises: a thickener of 5 to 25% by mass; and a base oil of 95 to 75% by mass with respect to the total mass of the thickener and the base oil. When the amount of the thickener is 5% by mass or less, the grease may be too soft, while the grease may be too hard when the amount is 25% by mass or greater.

The thickener which may be used in the embodiment is typically a urea comprising diurea compounds represented by any one of the formulae (1) to (6), and hence, the diurea compound having an aliphatic hydrocarbon group having 8 to 22 carbon atoms, an alicyclic hydrocarbon group having 6 to 12 carbon atoms, an aromatic hydrocarbon group having 6 to 20 carbon atoms can be used.

These urea comprising diurea compounds may be obtained by allowing an amine compound selected from aromatic amine, alicyclic amine and aliphatic amine to react with a diisocyanate compound.

Examples of the aromatic amine which may be used in the embodiment include aniline, aniline substituted with hydrocarbon and the like.

Examples of the alicyclic amine which may be used in the embodiment include cyclohexylamine, cyclohexylamine substituted with hydrocarbon and the like.

Examples of the aliphatic amine which may be used in the embodiment include octylamine (carbon number: 8), stearylamine (carbon number: 18), behenylamine (carbon number: 22) and the like.

Examples of the diisocyanate compound include diphenylmethane-4,4'-diisocyanate, 2,4-tolylenediisocyanate, 2,6-tolylenediisocyanate, a mixture of 2,4- and 2,6-tolylenediisocyanate, 3,3'-dimethyldiphenyl-4,4-diisocyanate and the like.

The base oil which may be used in the embodiment is a poly α-olefin mixture having a kinematic viscosity at 40° C. of 40 to 70 $mm^2/s$ prepared by mixing poly α-olefin (PAO HV) having a kinematic viscosity at 40° C. of 350 to 450 $mm^2/s$ with poly α-olefin (PAO LV) having a kinematic viscosity at 40° C. of 25 to 40 $mm^2/s$ in a mass ratio of 15:85 to 30:70. As the poly α-olefin oil for use in the embodiment, one having a flash point of 220° C. or higher is preferably employed for the purpose of use in safety.

Additionally, the poly (α-olefin oil which may be used in the embodiment has a structure generated by low-degree polymerization of (α-olefin to give an oligomer to which hydrogen is added at the terminal double bond. Typically, its structure can be represented by the following formula:

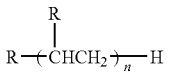

wherein R represents an alkyl group; and n represents an integer of 1 to 6.

Polybutene is also a kind of poly α-olefin, which can be produced by polymerization of a starting material including isobutylene as a principal component, with use of aluminum chloride as a catalyst. Polybutene may be used either without modification, or following the addition of hydrogen.

In the grease composition for a pivot assembly bearing, a lead free additive may be used as an additive. Examples of such an additive include oxidation inhibitors not including a lead atom, and rust-preventive agents not including a lead atom.

Specific examples of the oxidation inhibitor which can be used in the embodiment include amine-based oxidation inhibitors such as phenyl α(β)naphthylamine, alkyldiphenylamine and phenothiazine, phenol-based oxidation inhibitors typified by 4,4-methylenebis(2,6-di-t-butylphenol), and the like.

Also, specific examples of the rust-preventive agent which can be used in the invention include rust-preventive agents such as metal sulfonate, and those of nonionic base, amine base, and the like.

The grease composition of the embodiment can also contain a variety of additives not including lead which are generally used in greases, as needed. Examples of the additive include e.g., gelatinizing agents such as bentone and silica gel; extreme pressure agents such as those of sulfur-base, of phosphorus base and organic molybdenum; oiliness agents such as fatty acids, and animal and vegetable oils; rust retardants such as petroleum sulfonate, dinonylnaphthalene sulfonate, carboxylate and sorbitan esters; viscosity index improvers such as polymethacrylate, polyisobutylene and polystyrene, and the like.

Next, Examples will be demonstrated, however, the invention is not limited thereto.

Example 1

(Preparation of Thickener)

<Preparation of Urea A>

Aliphatic amine (behenylamine) in an amount of 4.8 g, 5.9 g of alicyclic amine (cyclohexylamine) and 9.3 g of diisocyanate (diphenylmethane-4,4'-diisocyanate) were provided.

<Preparation of Urea B>

Aromatic amine (dodecylaniline) in an amount of 5.6 g, 5.3 g of alicyclic amine (cyclohexylamine) and 9.1 g of diisocyanate (diphenylmethane-4,4'-diisocyanate) were provided.

(Preparation of Base Oil)

As the base oil, the following two types of the base oil were provided.

A poly α-olefin mixture having a kinematic viscosity at 40° C. of 52 $mm^2/s$ was produced as the base oil by mixing 15.2 g of poly α-olefin (PAO HV) having a kinematic viscosity at 40° C. of 400 $mm^2/s$ with 60.8 g of poly α-olefin (PAO LV) having a kinematic viscosity at 40° C. of 30 $mm^2/s$.

(Preparation of Additives)

As the oxidation inhibitor 2 g of alkyldiphenylamine was provided, while 2 g of calcium sulfonate was provided as the rust-preventive agent.

(Production of Grease)

<Preparation of Grease Using Urea A>

The grease using urea A can be prepared by reacting aliphatic amine, alicyclic amine and diisocyanate in a base oil (for example, a poly α-olefin mixture).

As for the aforementioned urea A, the raw material amine was allowed to react with diisocyanate in the base oil according to the above prepared quantity, and thereafter the mixture was heated while stirring. After holding at 150° C., the mixture was cooled to not higher than 100° C. The additives were mixed therewith sequentially, and the mixture was homogenized with a three-roll mill. By this procedure, the grease comprising the urea A with the diurea compounds resulted from the chemical reaction and represented by the formula (1) to (3) was obtained.

<Preparation of Grease Using Urea B>

The grease using urea B can be prepared by reacting aromatic amine, alicyclic amine and diisocyanate in a base oil (for example, a poly α-olefin mixture).

As for the aforementioned urea B, the raw material amine was allowed to react with diisocyanate in the base oil according to the above prepared quantity, and thereafter the mixture was heated while stirring. After holding at 150° C., the mixture was cooled to not higher than 100° C. The additives were mixed therewith sequentially, and the mixture was homogenized with a three-roll mill. By this procedure, the grease comprising the urea B with the diurea compounds resulted from the chemical reaction and represented by the formula (2), (4) and (5) was obtained.

<Preparation of Grease Using Urea A and Urea B>

The grease in which the urea A was used was mixed with the grease in which the urea B was used in a mass ratio of 1:4 to prepare a grease in which the urea A and the urea B were used.

The mass ratio between the thickener and the base oil with respect to the total mass of the grease was 20:76. This corresponds to a mass ration between the thickener and the base oil with respect to the total mass of the thickener and the base oil of 20.8:79.2.

Thickener: The mass ratio in the base oil was 20:76.

(Characteristic of Grease)

In thus resulting grease, the base oil having a pour point of −50° C. was used. Accordingly, a grease having favorable low temperature properties was obtained.

Example 2

(Preparation of Thickener)

<Preparation of Urea A>

Aliphatic amine (behenylamine) in an amount of 3.6 g, 4.4 g of alicyclic amine (cyclohexylamine) and 7.0 g of diisocyanate (diphenylmethane-4,4'-diisocyanate) were provided.

<Preparation of Urea B>

Aromatic amine (dodecylaniline) in an amount of 4.2 g, 4.0 g of alicyclic amine (cyclohexylamine) and 6.8 g of diisocyanate (diphenylmethane-4,4'-diisocyanate) were provided.

(Preparation of Base Oil)

As the base oil, the following two types of the base oil were provided.

A poly α-olefin mixture having a kinematic viscosity at 40° C. of 52 $mm^2/s$ was produced as the base oil by mixing 16.2 g of poly α-olefin (PAO HV) having a kinematic viscosity at 40° C. of 400 $mm^2/s$ with 64.8 g of poly α-olefin (PAO LV) having a kinematic viscosity at 40° C. of 30 $mm^2/s$.

(Preparation of Additives)

The additives were prepared in a similar manner to Example 1.

(Production of Grease)

The grease was prepared in a similar manner to Example 1.

<Preparation of Grease Using Urea A and Urea B>

The grease in which the urea A was used was mixed with the grease in which the urea B was used in a mass ratio of 1:1 to prepare a grease in which the urea A and the urea B were used.

The mass ratio between the thickener and the base oil with respect to the total mass of the grease was 15:81. This corresponds to a mass ration between the thickener and the base oil with respect to the total mass of the thickener and the base oil of 15.6:84.4.

(Characteristic of Grease)

In thus resulting grease, the base oil having a pour point of −50° C. was used. Accordingly, a grease having favorable low temperature properties was obtained.

Example 3

(Preparation of Thickener)

<Preparation of Urea A>

Aliphatic amine (behenylamine) in an amount of 2.4 g, 3.0 g of alicyclic amine (cyclohexylamine) and 4.6 g of diisocyanate (diphenylmethane-4,4'-diisocyanate) were provided.

<Preparation of Urea C>

Aliphatic amine (behenylamine) in an amount of 3.9 g, 3.1 g of aromatic amine (dodecylaniline) and 3.0 g of diisocyanate (diphenylmethane-4,4-diisocyanate) were provided.

(Preparation of Base Oil)

As the base oil, the following two types of the base oil were provided.

As for the aforementioned urea C, the raw material amine was allowed to react with diisocyanate in the base oil according to the above prepared quantity, and thereafter the mixture was heated while stirring. After holding 150° C., the mixture was cooled to not higher than 100° C. The additives were mixed therewith sequentially, and the mixture was homogenized with a three-roll mill. By this procedure, the grease comprising the urea B with the diurea compounds resulted from the chemical reaction and represented by the formula (1), (4) and (6) was obtained.

<Preparation of Grease Using Urea A and Urea C>

The grease in which the urea A was used was mixed with the grease in which the urea C was used in a mass ratio of 1:1 to prepare a grease in which the urea A and the urea C were used.

The mass ratio between the thickener and the base oil with respect to the total mass of the grease was 10:86. This corresponds to a mass ration between the thickener and the base oil with respect to the total mass of the thickener and the base oil of 10.4:89.6.

(Characteristic of Grease)

In thus resulting grease, the base oil having a pour point of−50° C. was used. Accordingly, a grease having favorable low temperature properties was obtained.

Examples 4 to 6

Grease compositions were obtained similarly to Example 1, 2 and 3 so that the composition as shown in Table 1 was formed.

TABLE 1

| | | Ex. 1 | Ex. 2 | Ex. 3 | Ex. 4 | Ex. 5 | Ex. 6 | Comparative Ex. 1 | Comparative Ex. 1 |
|---|---|---|---|---|---|---|---|---|---|
| Urea | A (aliphatic/alicyclic) | 4.0 | 7.5 | 5.0 | 5.0 | 5.0 | | 10.0 | 10.0 |
| (g) | B (alicyclic/aromatic) | 16.0 | 7.5 | — | 5.0 | 5.0 | 16.0 | | |
| | C (aromatic/aliphatic) | — | — | 5.0 | — | 5.0 | 4.0 | | |
| Thickener amount (mass %) | | 20.0 | 15.0 | 10.0 | 10.0 | 15.0 | 20.0 | 10.0 | 9.8 |
| Base oil | PAO (LV) | 60.8 | 64.8 | 68.8 | 68.8 | 64.8 | 60.8 | 43.0 | 43.0 |
| (g) | PAO (HV) | 15.2 | 16.2 | 17.2 | 17.2 | 16.2 | 15.2 | | |
| | Mineral oil | | | | | | | 43.0 | 43.0 |
| Additive | Oxidation inhibitor | 2.0 | 2.0 | 2.0 | 2.0 | 2.0 | 2.0 | 2.0 | 2.0 |
| (g) | Rust-preventive agent | 2.0 | 2.0 | 2.0 | 2.0 | 2.0 | 2.0 | 2.0 | 2.0 |
| | Organic lead compound | — | — | — | — | — | — | — | 2.0 |
| Worked penetration (25° C.) | | 216 | 241 | 265 | 261 | 253 | 239 | 252 | 256 |
| Kinematic viscosity of base oil (40° C.) ($mm^2/S$) | | 52 | 52 | 52 | 52 | 52 | 52 | 52 | 52 |
| Low temperature torque (−30° C.) starting/running (mN · m) | | 300/49 | 190/41 | 210/45 | 175/42 | 190/45 | 230/42 | 420/110 | 440/120 |

A poly α-olefin mixture having a kinematic viscosity at 40° C. of 52 $mm^2/s$ was produced as the base oil by mixing 17.2 g of poly α-olefin (PAO HV) having a kinematic viscosity at 40° C. of 400 $mm^2/s$ with 68.8 g of poly α-olefin (PAO LV) having a kinematic viscosity at 40° C. of 30 $mm^2/s$.

(Preparation of Additives)

The additives were prepared in a similar manner to Example 1.

(Production of Grease)

The grease using urea A was prepared in a similar manner to Example 1.

<Preparation of Grease Using Urea C>

The grease using urea C can be prepared by reacing aliphatic amine, aromatic amine and diisocyanate in a base oil (for example, α-olefin mixture).

Comparative Example 1

(Preparation of Thickener)

As the thickener, 2.4 g of aliphatic amine (stearylamine), 3.0 g of alicyclic amine (cyclohexylamine) and 4.6 g of diisocyanate (diphenylmethane-4,4'-diisocyanate) were provided.

The base oil and the additives were provided so as to give the ratio as shown in Table 1, and the grease composition was obtained similarly to Example 1.

Comparative Example 2

A grease composition was obtained by adding an organic lead compound (PbDTC dithiocarbamate lead) to the grease composition obtained in Comparative Example 1.

Kinematic viscosity of the base oil (40° C.) was determined according to JIS K2283; the worked penetration was determined according to JIS K2220 7; and the low temperature torque was determined according to JISK2220 18, respectively. The outgas property was determined for the evaporation loss at an atmospheric temperature of 85° C. for 3 hours. As the evaporation loss is lower, more excellent property is suggested.

Figures 3, 4:
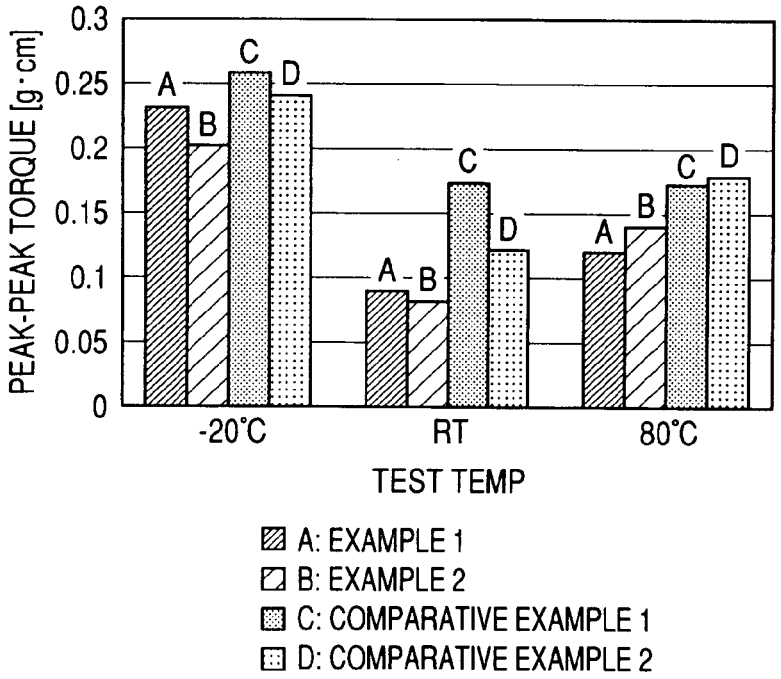
FIG. 3 shows data of peak-peak torque.
FIG. 4 shows a graph illustrating data of peak-peak torque.
Figure 5:
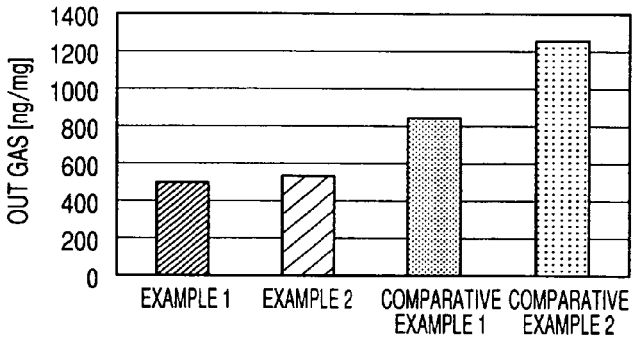
FIG. 5 shows data of outgas properties.
Figure 6:
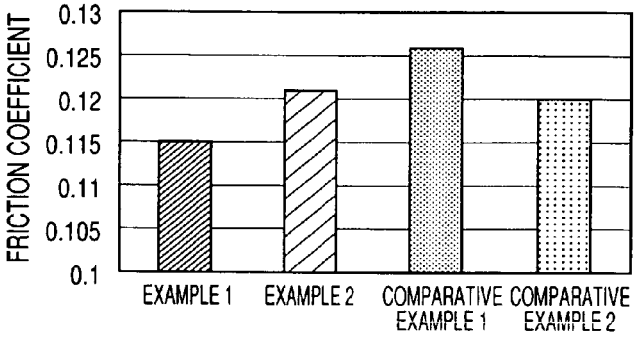
FIG. 6 shows data of frictional coefficient.

To demonstrate typical examples of the invention, the grease compositions for a pivot assembly bearing of Example 1 and Example 2, and the grease compositions of Comparative Example 1 and Comparative Example 2 are illustrated in FIG. 1 to FIG. 7 for on their property tests.

A grease composition for a pivot assembly bearing according to one aspect of the present invention can be readily produced, and in addition, it exerts certain properties in a low temperature range without adding any organic lead compound. Further, it provides a grease which is not harmful to the environment. Accordingly, abundant demand is anticipated, and great industrial applicability is expected.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

The present application claims foreign priority based on Japanese Patent Application Nos. JP2005-277822 and JP2006-255510, filed on Sep. 26 of 2005 and Sep. 21 of 2006, respectively, the contents of which is incorporated herein by reference.

What is claimed is:

1. A grease composition for a pivot assembly bearing, which comprises:

a thickener of 10 to 20% by mass; and a base oil of 90 to 79% by mass with respect to the total mass of the thickener and the base oil, wherein the thickener comprising two or more ureas selected from the group consisting of:

urea A comprising diurea compounds having at least one of an aliphatic substituent and an alicyclic substituent;

urea B comprising diurea compounds having at least one of an alicyclic substituent and an aromatic substituent; and urea C comprising diurea compounds having at least one of an aromatic substituent and an aliphatic substituent, wherein the base oil is a poly α-olefin mixture having a kinematic viscosity at 40° C. of 40 to 70 $mm^2/s$, wherein the poly α-olefin mixture is prepared by mixing poly α-olefin having a kinematic viscosity at 40° C. of 350 to 450 $mm^2/s$ with poly α-olefin having a kinematic viscosity at 40° C. of 25 to 40 $mm^2/s$ in a mass ratio of 15:85 to 30:70; and wherein urea A comprises a mixture of diurea compounds represented by formulae (1), (2) and (3):

(1)

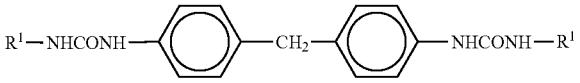

(2)

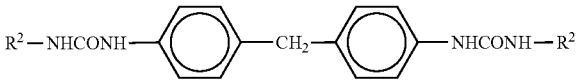

-continued (3)

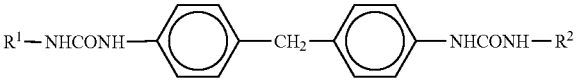

wherein $R^1$ represents an aliphatic hydrocarbon group having 8 to 22 carbon atoms, and $R^2$ represents an alicyclic hydrocarbon group having 6 to 12 carbon atoms;

urea B comprises a mixture of diurea compounds represented by formulae (2), (4) and (5):

(2)

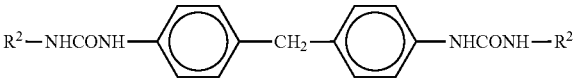

(4)

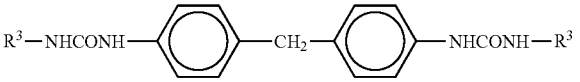

(5)

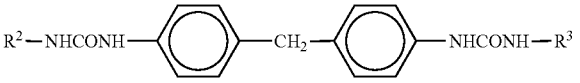

wherein $R^2$ represents an alicyclic hydrocarbon group having 6 to 12 carbon atoms, and $R^3$ represents an aromatic hydrocarbon group having 6 to 20 carbon atoms; and urea C comprises a mixture of diurea compounds represented by formulae (1), (4) and (6):

(1)

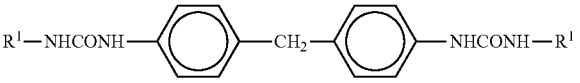

(4)

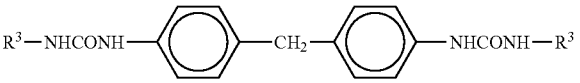

(6)

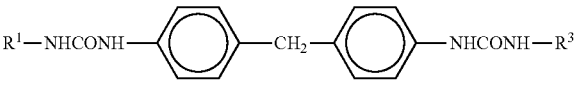

wherein $R^1$ represents an aliphatic hydrocarbon group having 8 to 22 carbon atoms, and $R^3$ represents an aromatic hydrocarbon group having 6 to 20 carbon atoms.

2. The grease composition according to claim 1, which further comprises a lead free additive.

3. The grease composition according to claim 1, wherein the two or more ureas comprise the urea A and the urea B.

4. The grease composition according to claim 1, wherein the two or more ureas comprise the urea B and the urea C.

5. The grease composition according to claim 1, wherein the two or more ureas comprise the urea A and the urea C.

6. The grease composition according to claim 1, wherein the two or more ureas comprise the urea A, the urea B and the urea C.

7. A bearing for pivot assembly, wherein a grease composition according to claim 1 is filled.

* * * * *